US007147256B2

(12) United States Patent
Gill

(10) Patent No.: US 7,147,256 B2
(45) Date of Patent: Dec. 12, 2006

(54) FOLD DOWN WINDOW OPERATOR

(75) Inventor: David B. Gill, Elkhorn, WI (US)

(73) Assignee: Newell Operating Company, Atlanta, GA (US)

( * ) Notice: Subject to any disclaimer, the term of this patent is extended or adjusted under 35 U.S.C. 154(b) by 149 days.

(21) Appl. No.: 10/811,064

(22) Filed: Mar. 26, 2004

(65) Prior Publication Data

US 2005/0212305 A1 Sep. 29, 2005

(51) Int. Cl.
*E05B 3/00* (2006.01)

(52) U.S. Cl. ..... 292/336.3; 292/DIG. 31; 49/324; 16/429; 16/900

(58) Field of Classification Search ..... 292/336.3, 292/DIG. 31; 16/429, 900; 74/543, 545, 74/547; 49/324, 339, 341, 345, 346
See application file for complete search history.

(56) References Cited

U.S. PATENT DOCUMENTS 2,355,932 A * 8/1944 Albert ..... 49/325
3,007,348 A * 11/1961 Barnes ..... 74/547
3,148,913 A * 9/1964 Hans ..... 296/223
3,976,325 A * 8/1976 Schatzler ..... 296/223
4,023,858 A * 5/1977 Bienert et al. ..... 296/221
4,162,805 A * 7/1979 Hirschberger ..... 296/223
4,189,248 A 2/1980 Sully
4,294,134 A * 10/1981 Mori et al. ..... 74/547
4,390,203 A * 6/1983 Lutz et al. ..... 296/223
4,466,658 A * 8/1984 Furst et al. ..... 296/223
4,524,921 A * 6/1985 Ozaki et al. ..... 242/284
4,567,692 A * 2/1986 Vogt et al. ..... 49/477.1
4,811,623 A * 3/1989 Tomiser, Jr. ..... 74/547
4,867,491 A 9/1989 Arnold
4,937,976 A 7/1990 Tucker et al.
4,984,489 A 1/1991 Krauthamer
5,168,770 A * 12/1992 Ellis ..... 74/545
5,201,241 A * 4/1993 Pollack, Jr. ..... 74/528
D336,233 S * 6/1993 Zimmermann ..... D8/309
5,400,473 A 3/1995 Delman
5,409,272 A * 4/1995 McCormack ..... 292/66
5,410,778 A * 5/1995 Langevin ..... 16/429
5,467,503 A 11/1995 Nolte et al.
D369,741 S * 5/1996 Harrison et al. ..... D8/400
5,551,316 A * 9/1996 Blank ..... 74/547
5,560,082 A * 10/1996 Vetter ..... 16/429
D390,777 S * 2/1998 Peterson et al. ..... D8/400
5,740,632 A 4/1998 Peterson et al.
5,802,673 A * 9/1998 Nemeth ..... 16/429

(Continued)

FOREIGN PATENT DOCUMENTS

DE 19845707 A1 4/2000

(Continued)

*Primary Examiner*—Brian E. Glessner
*Assistant Examiner*—Carlos Lugo
(74) *Attorney, Agent, or Firm*—Banner & Witcoff, Ltd.

(57) ABSTRACT

A fold down operator (10) is provided for a rotatable spindle (224) of casement window assembly (200). The operator (10) comprises a hub (12) and a handle (48). The hub (12) has a receiver (22) and an arm (32) extending from the receiver (22). The receiver (22) is adapted to connect to the spindle (224). The handle (48) has a cavity (112). The handle (48) is pivotally connected to the arm (32) such that the handle (48) is pivotable between a closed position wherein a portion of the receiver (22) is positioned within the cavity (112), and an open position, wherein the receiver (22) is outboard of the cavity (112).

47 Claims, 7 Drawing Sheets

U.S. PATENT DOCUMENTS

| | | | | | |
|---|---|---|---|---|---|
| 5,975,594 | A | * | 11/1999 | Sandhu et al. | 292/173 |
| 6,164,156 | A | * | 12/2000 | Purcell | 74/547 |
| 6,375,382 | B1 | | 4/2002 | Clavet | |
| 6,450,063 | B1 | * | 9/2002 | Harvey et al. | 74/547 |
| 6,598,265 | B1 | * | 7/2003 | Lee | 16/429 |
| 6,640,389 | B1 | * | 11/2003 | Van Klompenburg et al. | 16/429 |
| D497,304 | S | * | 10/2004 | Stoll et al. | D8/337 |
| 2002/0066162 | A1 | | 6/2002 | Klompenburg et al. | |
| 2003/0029001 | A1 | | 2/2003 | Klompenburg et al. | |

FOREIGN PATENT DOCUMENTS

| | | | | |
|---|---|---|---|---|
| EP | 0861955 | A2 | | 9/1998 |
| GB | 2082518 | | * | 3/1982 |
| GB | 2263722 | A | | 8/1993 |

* cited by examiner 10
52
48
20
14
226
22
38
12
34
32
42
36
88
86
90
96
94
54
30
112
116
142
224
76
40
46
72
114
101
108
102
98
104
106
156
140A
138
222
142

86
100
94
56
64
112
10
106
50
52
54
48
226
34
A2
101
104
108
60
20
32
36
12
76
14
30
152
116
140A
118
22
154
72
114
142
224
146
44
120
140
156
140C
138
222
142

FOLD DOWN WINDOW OPERATOR

TECHNICAL FIELD

The present invention is generally directed to an operator for a window assembly. More particularly, the present invention relates to a fold down window operator for use on a casement window assembly.

BACKGROUND OF THE INVENTION

In general terms, window assemblies include a frame assembly that operably supports a piece of glass. One common type of window assembly is a casement window assembly that is often found in commercial and residential applications. A casement window assembly generally includes a frame assembly and a window assembly. The window assembly is operably connected to the frame assembly such that it can be moved between an open position and a closed position. The frame assembly normally supports a window operator that typically includes a rotary assembly having a spindle. A rotary handle is mated to the spindle such that the handle extends outward from the window assembly. Rotation of the spindle through actuation of the rotary handle moves arms of the window operator that are connected to the window assembly to move the window assembly between the open and closed positions.

Typically, the rotary handle remains fixed to the spindle with which it is mated. Thus, the handle remains in a position extended away from the window assembly. One disadvantage of this position is that the protruding handle creates a hazard. For example, an individual walking in the vicinity of the window assembly may inadvertently come into contact with the protruding handle causing injury or damaging the clothing of the individual. Another disadvantage of this protruding handle is the potential of the handle interfering with window treatments and accessories, such as drapes, blinds, and shades. The protruding handle may interfere with the path of travel of these window treatments. Yet another disadvantage of the traditional rotary handle is the unpleasant aesthetic quality of a handle protruding from the window assembly. Thus, it would be desirable to have a handle that would provide better functionality and a more aesthetically pleasing look to the window assembly when the handle is not in use.

The operator of the present invention is designed to solve these and other related problems.

SUMMARY OF THE INVENTION

The present invention relates to an operator for use in operating a casement window assembly. Specifically, the present invention provides a fold down operator for a rotatable spindle of a rotary device for a casement window assembly. The operator generally comprises a hub, a handle, and a cover. The hub generally comprises a body and an arm. The body includes a receiver adapted to receive the spindle of the rotary assembly. The arm extends outward from the body of the hub, and includes a nose. The arm also includes a hole passing through the nose.

The handle comprises a base and a pair of sidewalls which cooperate to form a cavity. The first end of the handle includes a peg, a leaf spring, and a pair of slots. The leaf spring has a hole. The leaf spring is positioned in the slots of the handle and retained by the engagement of the peg with the hole in the leaf spring. The second end of the handle generally includes a foundation, a knob, and a connector.

The foundation has a hole which receives the connector. The connector passes through the knob and is received by the hole in the foundation to rotatably connect the knob to the second end of the handle. The handle is pivotally connected to the hub by a pin that passes through the first end of the handle and through the hole in the nose of the hub.

The cover of the operator includes a base and a pair of sidewalls extending from the base to form a cavity. The base has a top surface and a bottom surface. The top surface of the base includes an opening cooperatively dimensioned with the spindle of the window assembly. The top surface of the base also includes a protrusion and a second recess. The protrusion provides a smooth look to the operator for improved aesthetics. The second recess allows the first end of the handle to avoid contact with the base of the cover when the handle is actuated between an open and closed position. The bottom surface of the base include a pair of fingers, each finger having a tooth. The resilient fingers and teeth are adapted to engage a portion of the rotary assembly of the window to secure the cover to the window.

According to one aspect of the invention, the cover overlies the rotary assembly of the casement window but allows the spindle to protrude through the opening. The spindle is then mated to the receiver of the hub. Rotation of the handle and hub imparts rotation on the spindle which actuates the window assembly between an open and closed position.

According to another aspect of the invention, the handle of the operator is pivotally connected to the arm of the hub, and is pivotable between an open position and a closed position. In the closed position, a portion of the receiver is within the cavity of the handle. In the open position, the receiver is outboard of the cavity.

According to yet another aspect of the invention, the handle of the operator is connected to the arm of the hub, and is pivotable between from a closed position, to an intermediate position, and further to an open position. In the closed and open positions, the leaf spring of the handle is unflexed. In the intermediate position, the nose of the arm engages the leaf spring of the handle to flex the leaf spring.

According to yet another aspect of the invention, when the handle is in the closed position, the hub is within the cavity of the handle, and the handle is substantially flush with the cover. Stated in other terms, the peripheral edges of the handle are in communication with the top surface of the base of the cover.

According to yet another aspect of the invention, when the handle is in the closed position, at least a portion of the knob of the handle is received in the first recess of the cover and the open terminal end of the recess exposes the terminal end surface of the knob to provide a gripping surface for a user to lift the handle away from the cover recess.

Other features and advantages of the invention will be apparent from the following specifications taken in conjunction with the following drawings.

BRIEF DESCRIPTION OF THE DRAWINGS

The present invention will now be described with reference to the accompanying drawings, in which.

DETAILED DESCRIPTION

Figure 1:
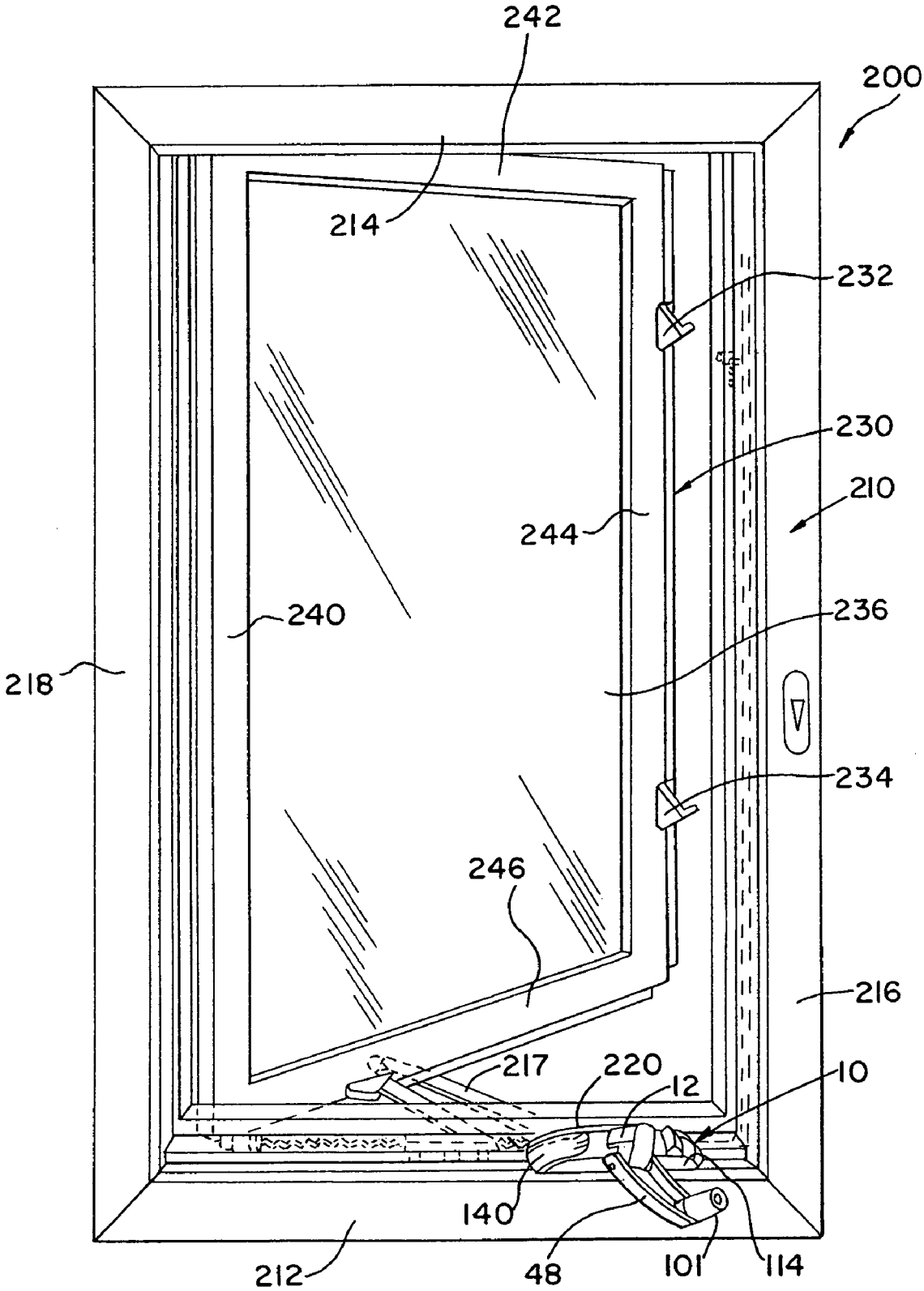
FIG. 1 shows a front view of a casement window assembly including the operator of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention relates to an operator 10 for use in operating a casement window assembly 200. Referring to FIG. 1, the casement window assembly 200 includes a frame assembly 210 and a window assembly 230. The frame assembly 210 includes a plurality of horizontal and vertical frame members 212, 214, 216, 218. The window assembly 230 is shown having two latches or keepers 232,234 mounted thereto. The window assembly 230 includes a glass pane 236 supported by a plurality of window frame members 240, 242, 244, 246.

Referring to FIGS. 1–4, the frame assembly 210 further includes a rotary assembly 220 mounted on the base frame member 212. The rotary assembly 220 is adapted to permit an operator to move the window assembly 230 in the frame assembly 210 between an open position and a closed position. The rotary assembly 220 includes a base 222 and a spindle 224 extending outward from the base 222. The spindle 224 is operably linked to the window assembly 230 by one or more operator arms 217. The spindle 224 further includes an arrangement of splines 226 extending radially outward from the spindle 224. Rotation of the spindle 224 operates the rotary assembly 220 to move the window assembly 230 between the open and closed positions. The rotary assembly 220 may further include a mounting or interface plate to facilitate engagement of the rotary assembly 220 with the base frame member 212 of the frame assembly 210.

As seen in FIGS. 2–4A, the operator 10 of the present invention generally comprises a hub 12, a handle 48, and a cover 114. The handle 48 of the operator 10 is pivotally connected to the hub 12. It is understood that the operator 10 could readily function without the cover 114.

Figure 5:
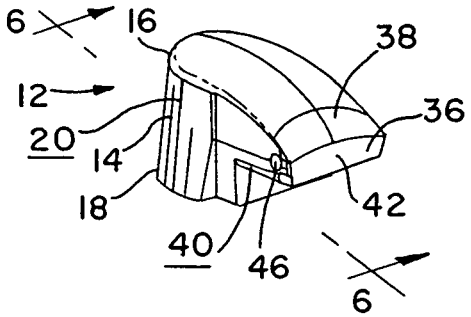
FIG. 5 shows a perspective view of a hub of the operator.
Figure 6:
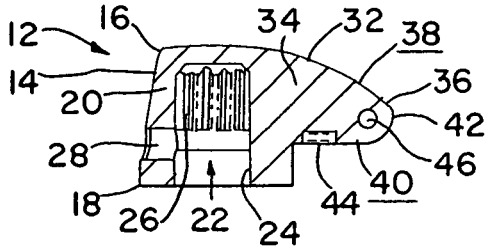
FIG. 6 shows a cross-sectional view of the hub of FIG. 5 taken along lines 6—6 of FIG. 5.

Referring to FIGS. 5 and 6, the hub 12 generally comprises a body 14 and an arm 32. The body 14 has a top portion 16, a bottom portion 18, and an outer surface 20. The top portion 16 of the body 14 is connected to the arm 32. The bottom portion 18 of the body 14 includes a hollow receiver 22 having an inner wall 24. The receiver 22 has an opening that with a central axis, is adapted to receive the spindle 224 of the frame assembly 210 such that the receiver opening central axis aligns with the central axis of the elongated body of the spindle 224. The inner wall 24 of the receiver 22 includes an arrangement of splines 26 adapted to mate with the splines 226 of the spindle 224 extending from the rotary assembly 220. The bottom portion 18 of the body 14 further includes an aperture 28 passing through the outer surface 20 of the body 14 and into the receiver 22. A set screw 30 is mated with the aperture 28. The set screw 30 is adapted to pass in and out of the aperture 28 so as to engage a portion of the spindle 224 within the receiver 22.

The arm 32 of the hub 12 extends radially outward from the body 14 of the hub 12, in a direction generally perpendicular to an axis of the receiver 22. The arm 32 has a first end 34 and a second end 36. The first end 34 of the arm 32 is attached to the body 14 of the hub 12, while the second end 36 of the arm 32 is outboard from the body 14. In a preferred embodiment, the arm 32 is integral with the body 14. The arm 32 further has a top surface 38, a bottom surface 40, and a nose 42. The top surface 38 of the arm 32 has a generally curvilinear configuration, as seen in FIG. 6. The top surface 38 preferably has radius of curvature that substantially mates with the curvature of the handle 48 that resides over the arm 32 when the handle 48 is in the closed configuration. More specifically, the hub arm 32 top surface 38 is rounded as a mound-like shape, to substantially mate with the curvature of the base 50 of the handle 48. This rounded surface shape is at least partially defined by a curvature of the top surface 38 along an extent from the area of the receiver 22 to the end of the arm 32. Thus, as the handle is moved to the use configuration shown in FIG. 4, the curvature of the top surface 38 provides clearance for passage of the extending body of the first end 72 of the handle. Furthermore, the rounded surface shape of the top surface 38 also has a curvature across the width of the arm 32. This curvature, substantially mates with the decorative curvature of the handle width, thus providing clearance for deployment of the handle. The bottom surface 40 is generally opposite the top surface 38, and has a generally flat configuration. The bottom surface 40 includes a well 44 proximate the second end 36 of the arm 32. The nose 42 has a generally curvilinear configuration, and is located at the second end 36 of the arm 32. The nose 42 extends outward slightly pronounced than the adjacent areas of the arm 32. As shown in the Figures (see FIGS. 2A–4A), the nose 42 is formed as a protruding portion of the arm 32, such that the thickness of the nose 42 (between the outer surface of the nose 42 and the opening 46 for the hinge pin 84) is greater than the thickness between the top surface 38 and the hinge pin 84. In this manner, the nose 42 is a protruding body of the arm 32 that extends generally between the top surface 38 and the bottom surface 40 of the arm 32, and thereby provides an extended nose surface that protrudes from the handle hinge further than that of the surfaces at the top or bottom areas 38,40. As shown in the Figures (FIGS. 2A–4A) this extended surface at the nose 42, provides an extended body that is configured to approach the inner surface of the handle 48, which thereby provides that structure for frictional engagement between the nose 42 and an internal spring member 76 positioned on the inner surface of the handle 48.

Figure 7:
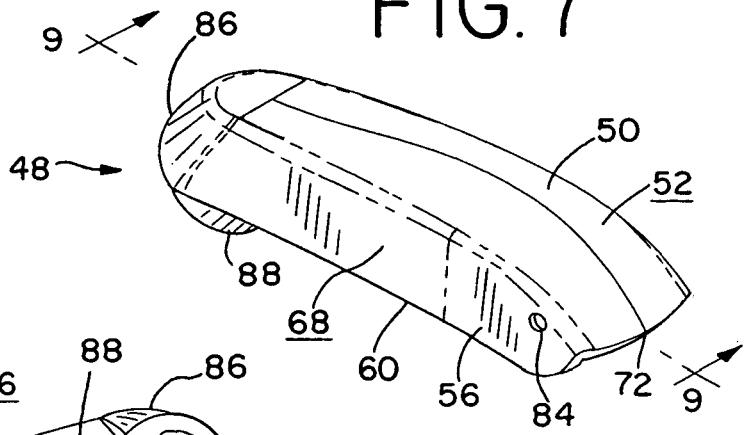
FIG. 7 shows a perspective view of the top of a handle of the operator.
Figure 8:
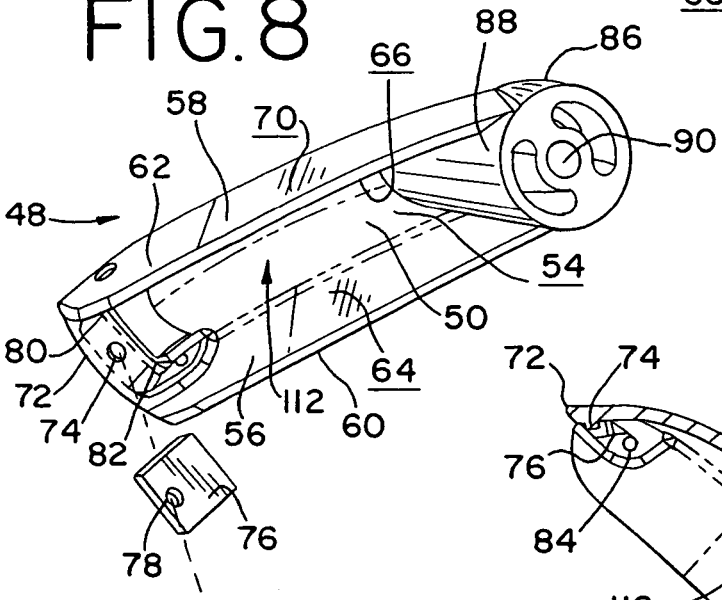
FIG. 8 shows an exploded perspective view of the bottom of the handle of FIG. 7.
Figure 9:
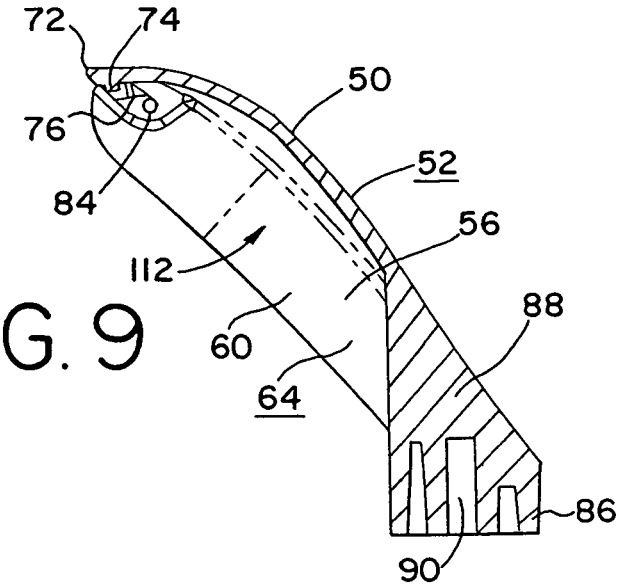
FIG. 9 shows a cross-sectional view of the handle of FIG. 7 taken along lines 9—9 of FIG. 7.

As seen in FIGS. 7–9, the handle 48 is pivotally connected to the hub 12. The handle 48 has a first end 72 and a second end 86. The first end 72 of the handle 48 is proximate the hub 12 while the second end 86 of the handle 48 is outboard of the hub 12. The handle 48 generally comprises a base 50 and a pair of sidewalls 56,58. The base 50 has a top surface 52 and a generally opposed bottom surface 54. The sidewalls 56,58 are generally parallel, and extend from the bottom surface 54 of the base 50. Each sidewall 56,58 includes a peripheral edge 60,62 away from the base 50. The sidewalls 56,58 each have an inner surface 64,66 and an outer surface 68,70. The inner surfaces 64,66 of the sidewalls 56,58 generally face one another while the outer surfaces 68,70 of the sidewalls 56,58 face away from one another. The handle 48 includes a cavity 112 formed by the base 50 and sidewalls 56, 58. Specifically, the inside surfaces 64,66 of the sidewalls 56,58 and the bottom surface 54 of the base 50 cooperate to define the cavity 112.

As further shown in FIGS. 7–9, the first end 72 of the handle 48 further includes a peg 74, a leaf spring 76, and a pair of slots 80,82. Specifically, the peg 74 projects from the bottom surface 54 of the base 50 and into the cavity 112. The inner surfaces 64,66 of the sidewalls 56,58 include a pair of slots 80,82 adapted to receive the leaf spring 76. The leaf spring 76 has a generally rectangular configuration, and includes a hole 78. The leaf spring 76 is positioned in the slots 80,82 of the sidewalls 56,58, and the peg 74 is positioned within the hole 78 of the leaf spring 76. The peg 74 engages the hole 78 of the leaf spring 76 and retains the leaf spring 76 in position in the slots 80,82. The leaf spring 76 thus generally confronts a portion of the bottom surface 54 of the base 50. The leaf spring 76 uniquely cooperates with the hub 12 and handle 48 for improved operation as will be further described below. The first end 72 of the handle 48 also includes a pin 84. The pin 84 extends between the sidewalls 56,58 and is affixed to the inside surfaces 64,66 of the sidewalls 56,58. The pin 84 is adapted to pass through the hole 46 in the arm 32 of the hub 12 so as to pivotally connect the handle 48 to the hub 12.

Figure 2:
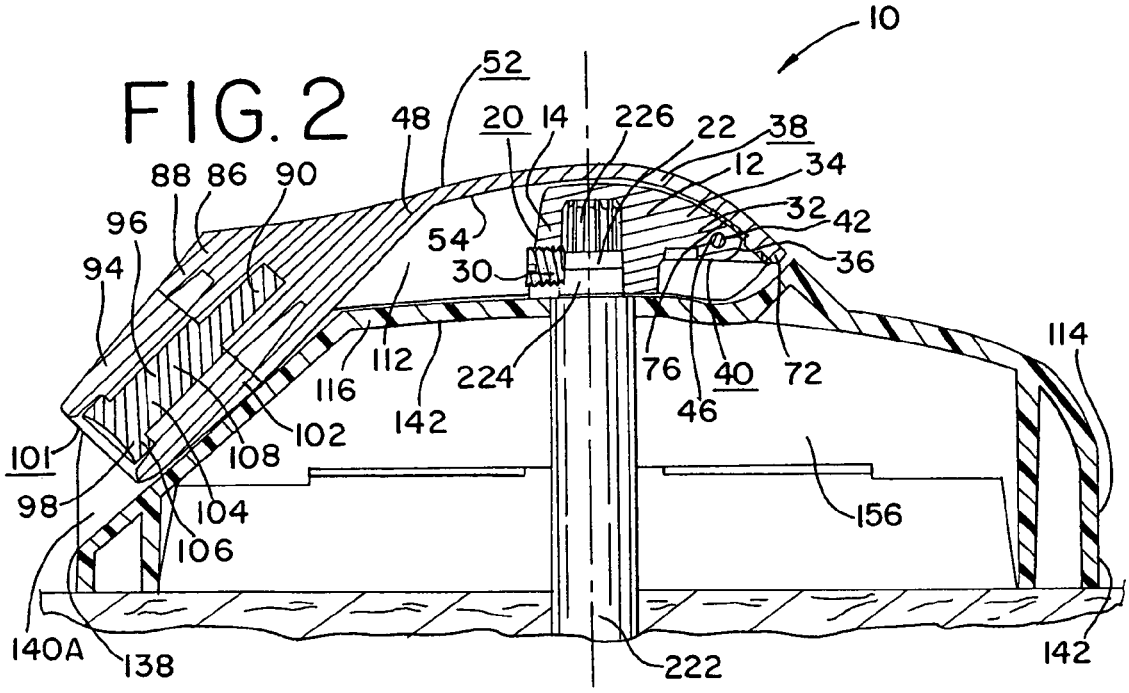
FIG. 2 shows a cross-sectional view of the operator of the present invention installed on a rotatable spindle of the casement window assembly, the operator in a closed position.
Figure 3:
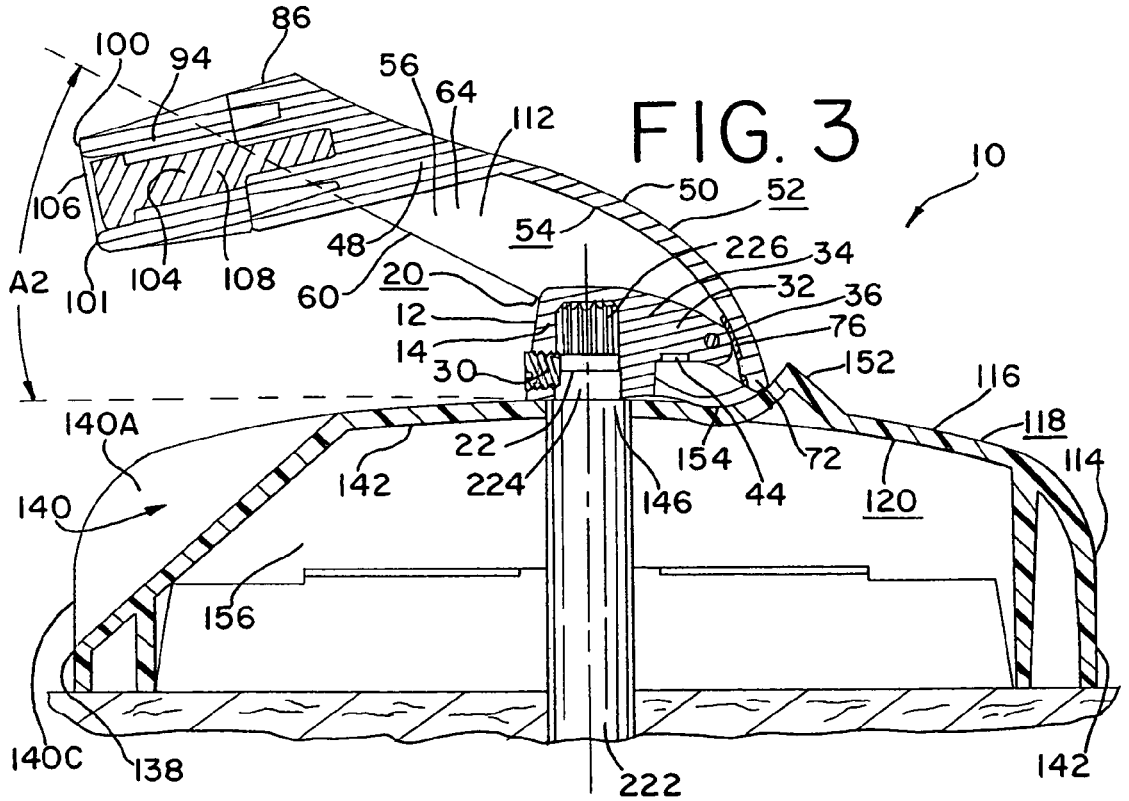
FIG. 3 shows the operator of FIG. 2 in an intermediate position.
Figure 4A:
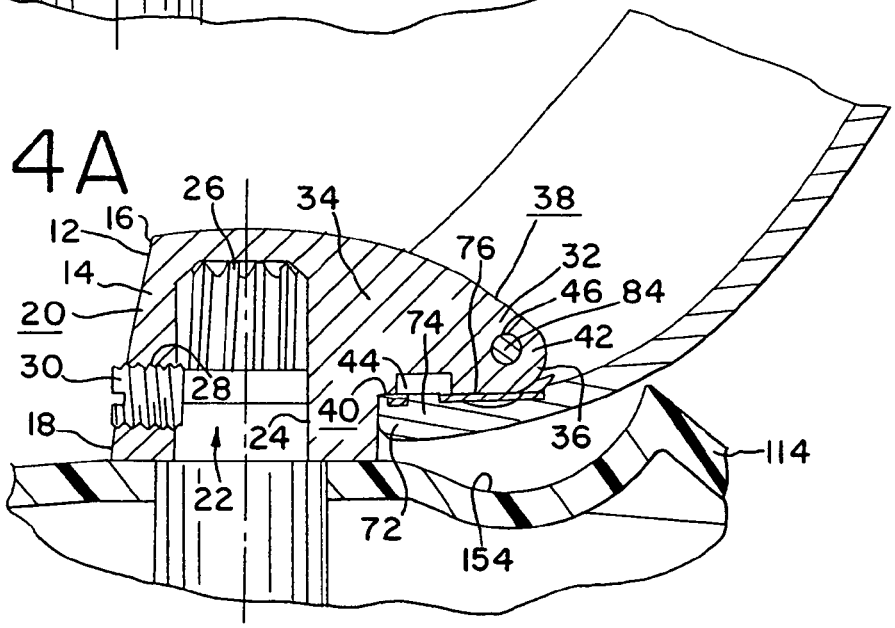
FIG. 4A shows a partial enlarged cross-sectional view of the operator of FIG. 4.
Figure 4:
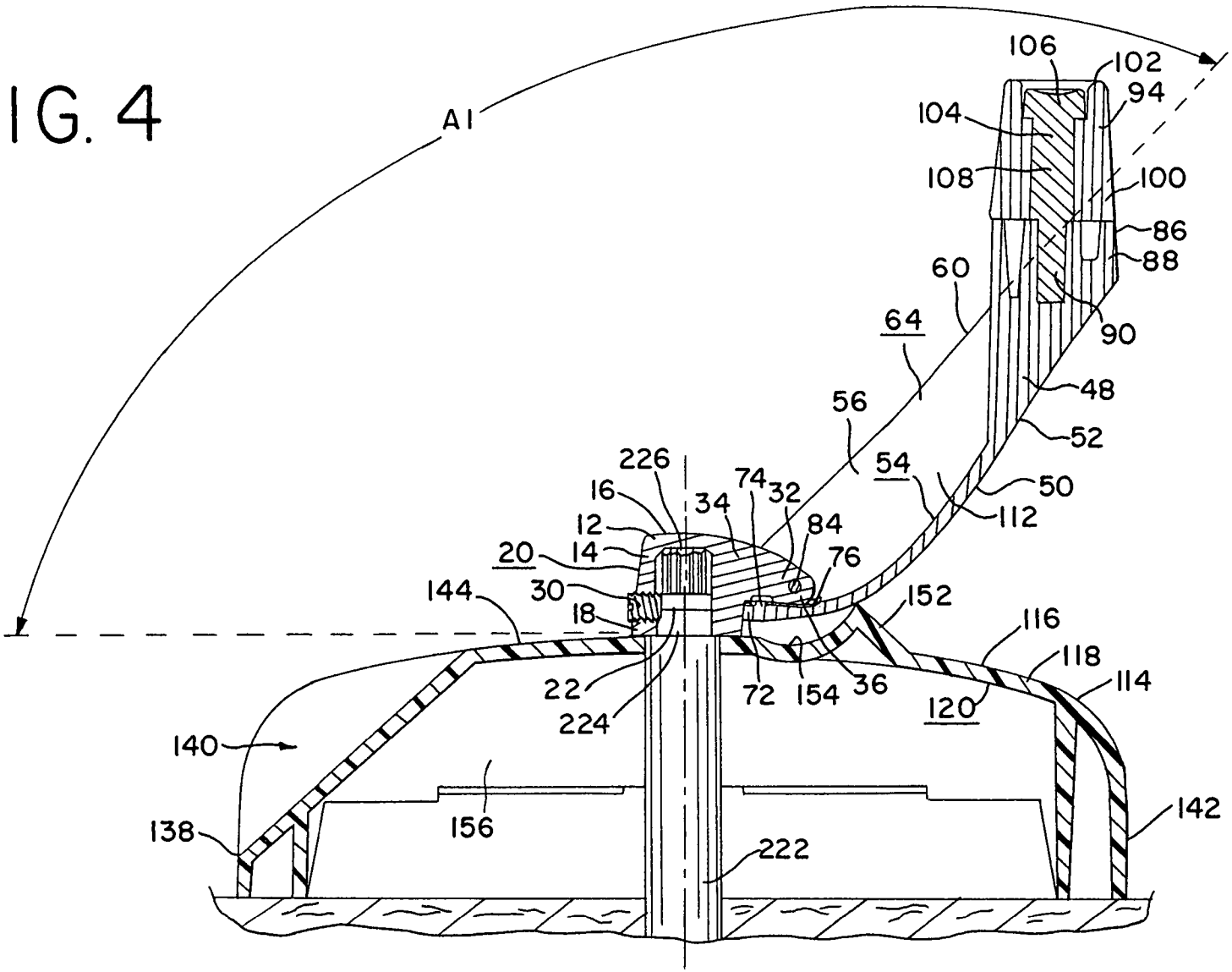
FIG. 4 shows the operator of FIG. 2 in an open position.

As generally shown in FIGS. 2–4A and 7–9, the second end 86 of the handle 48 generally includes a foundation 88, a knob 94, and a connector 104. The connector 104 serves to rotatably connect the knob 94 to the foundation 88. The foundation 88 comprises a substantially solid structure located at the second end 86 of the handle 48. Preferably, the foundation 88 extends into the cavity of the handle 48, as seen in FIG. 9. The foundation 88 includes a hole 90 adapted to receive the connector 104. Preferably, the hole 90 retains the connector 104 in a friction fit, however, the hole 90 may alternately include an arrangement of splines (not shown). All that is required is that the foundation 88 have structure capable of securing the connector 104 to the handle 48. As shown in FIG. 4, the knob 94 generally has a first end 100 and a second end 102. The shape of the knob 94 is generally curvilinear and the knob 94 tapers from the first end 100 to the second end 102. Thus, the knob 94 has a generally frustoconical shape. The knob 94 has an axial hole 96 passing through its length. Furthermore, the knob 94 has a recessed well 98 located in the second end 102 of the knob 94. The connector 104 generally has a head 106 and a shaft 108. The head 106 of the connector 104 is cooperatively dimensioned with the well 98 in the knob 94. The shaft 108 of the connector 104 is cooperatively dimensioned with the hole 96 in the knob 94. The shaft 108 of the connector 104 passes through the hole 96 in the knob 94 and into the hole 90 in the foundation 88 to connect the connector 104 to the handle 48. The head 106 of the connector 104 engages the well 98 of the knob 94 to prevent the knob 94 from separating from the connector 104. The shaft 108 of the connector 104 engages the hole 90 in the foundation 88 in a friction fit. Thus, the shaft 108 connects to the hole 90 to rotatably secure the knob 94 to the foundation 88. The dimensions of the hole 96 in the knob 94 and the thickness of the shaft 108 of the connector 104 are proportioned such that the knob 94 is free to rotate about the shaft 108 of the connector 104. This can be accomplished via a variety of connection methods well known in the art.

Figure 10:
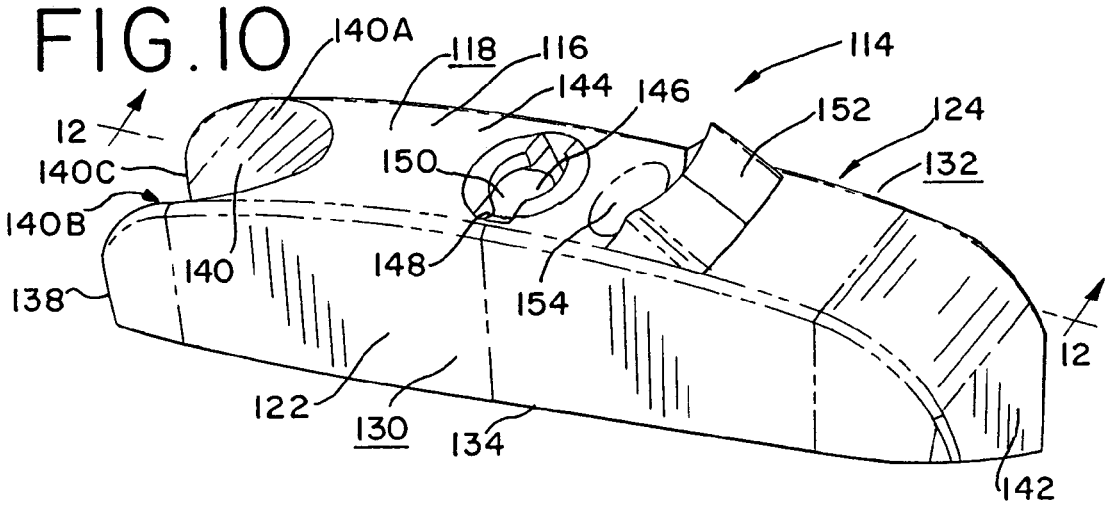
FIG. 10 shows a perspective view of the top of a cover of the operator.
Figure 11:
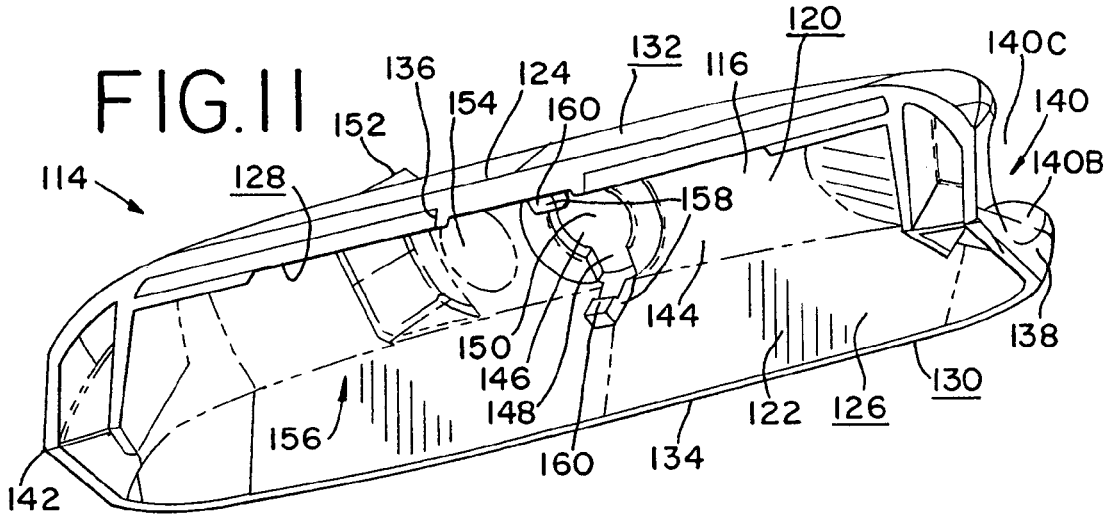
FIG. 11 shows a perspective view of the bottom of the cover of FIG. 10.
Figure 12:
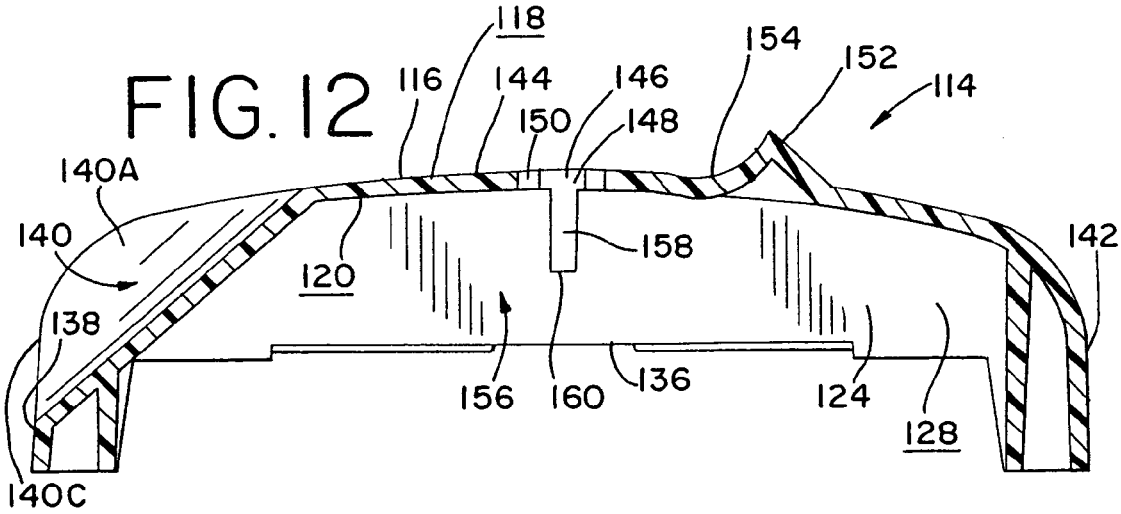
FIG. 12 shows a cross-sectional view of the cover of FIG. 10 taken along lines 12—12 of FIG. 10.

The operator 10 further includes the cover 114, shown in FIGS. 10–12. The cover 114 serves to improve the aesthetic appearance of the operator 10 by covering the rotary assembly 220 of the frame assembly 210. The cover 114 generally includes a base 116 and a pair of sidewalls 122,124. The base 116 has a top surface 118 and a bottom surface 120. The top surface 118 of the base 116 faces generally away from the rotary assembly 220 while the bottom surface 120 faces towards the rotary assembly 220. The sidewalls 122,124 are generally parallel and extend from the bottom surface 120 of the base 116. Each sidewall 122,124 has a peripheral edge 134,136 away from the base 116. The sidewalls 122,124 each have an inner surface 126,128 and an outer surface 130,132. The inner surfaces 126,128 of the sidewalls 122, 124 generally face towards one another while the outer surfaces 130,132 of the sidewalls 122,124 face away from one another. The base 116 and sidewalls 122,124 cooperate to form a cavity 156 in the cover 114. Specifically, the inner surfaces 126,128 of the sidewalls 122,124 and the bottom surface 120 of the base 116 cooperate to define the cavity 156 of the cover 114. The cover 114 includes a pair of resilient fingers 158, best seen in FIG. 11. The fingers 158 are located within the cavity 156 of the cover 114. Each finger 158 depends partially from the bottom surface 120 of the base 116, and partially from one of the inner surfaces 126,128 of the sidewalls 122,124. Each finger 158 includes a tooth 160 at one end. The fingers 158 and the teeth 160 are adapted to engage a portion of the rotary assembly 220 of the frame assembly 210 to secure the cover 114 to the frame assembly 210.

The cover 114 has a first end 138, a central portion or middle portion 144, and a second end 142, as seen in FIG. 10. The middle portion 144 of the cover 114 has an opening 146. The opening 146 comprises a slot 148 extending towards the sidewalls 122,124, and a generally circular hole 150. The opening 146 is adapted to permit the spindle 224 of the rotary assembly 220 to pass through. The first end 138 of the cover 114 includes a first recess 140. The first recess 140 is located between the sidewalls 122,124 of the cover 114. More specifically, the recess 140 is formed of generally opposed recess sidewalls 140A, 140B, and is cooperatively dimensioned to receive at least a portion of the knob 94 of the handle 48. The first recess 140 is formed in the top surface 118 of the base 116 of the cover 114, and has an open terminal end 140C. As shown in the Figures (FIGS. 2 and 10), the preferred embodiment of the invention provides a generally U-shaped recess 140 that appears as a channel with a top area for receiving the handle 48, and the open end 140C of the recess 140 exposing the end of the knob 94 so the user may deploy the handle by placing his or her finger in the recess open end 140C and lifting the gripping portion of the knob provided by the terminal knob surface 101. The second end 142 of the cover generally includes a protrusion 152 and a second recess 154. The protrusion 152 extends outward from the top surface 118 of the base 116. The protrusion 152 is cooperatively dimensioned with the first end 72 of the handle 48 and provides an additional aesthetic quality to the operator 10 when the handle 48 and cover 114 are connected. The second recess 154 is located between the opening 146 and the protrusion 152. The second recess 154 is cooperatively dimensioned with the first end 72 of the handle 48 so as to provide a clearance for the handle 48 when it is pivoted about the hub 12.

The operator 10 is connected to the frame assembly 210 of the casement window 200, as seen in FIG. 1. The cover 114 of the operator 10 is placed over the rotary assembly 220 and pressed into place until the fingers 158 and teeth 160 of the cover 114 engage a portion of the rotary assembly 220 to secure the cover 114 to the frame assembly 210. The spindle 224 of the rotary assembly 220 passes up through the opening 146 in the cover 114 where it is exposed above the top surface 118 of the base 116 of the cover 114. This construction of the cover, with integrally formed fingers 158 and teeth 160 for securement to the spindle of the window, is a construction that is well suited for the entire cover assembly 114 to be formed of plastic, preferably as a single molded piece of plastic that has the fingers 158 and teeth 160 molded in the interior of the cover 114, and a void of plastic presenting the opening 146 for receiving the spindle.

Figure 13:
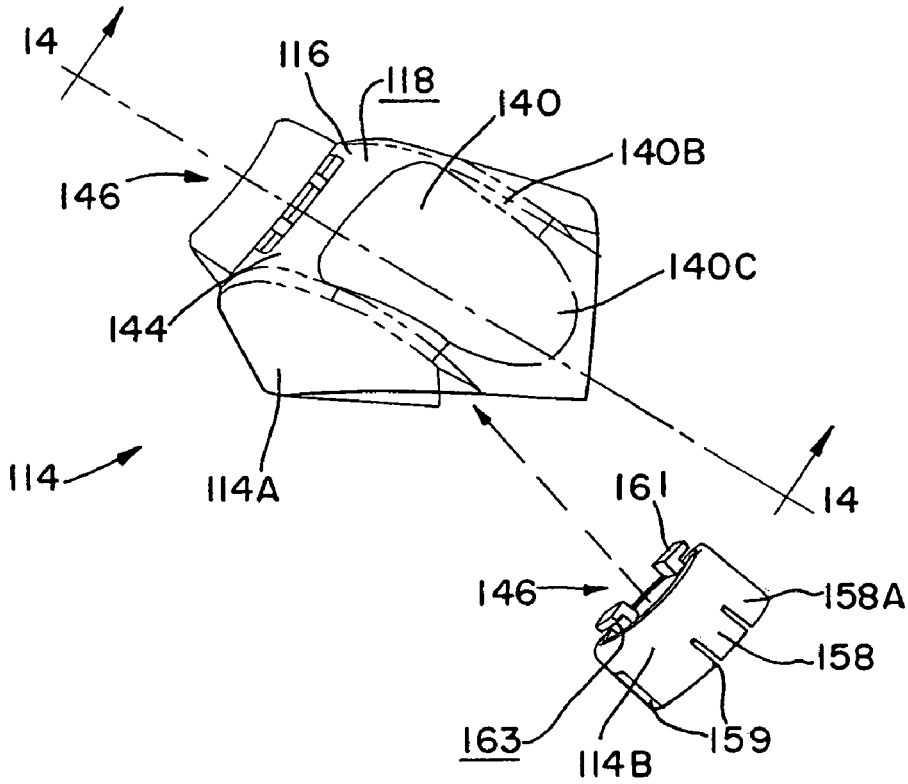
FIG. 13 is an exploded perspective view showing an alternative embodiment of the cover depicted in FIGS. 10 and 11, constructed from mating parts to form the opening that receives and secures the spindle of a window mechanism.
Figure 14:
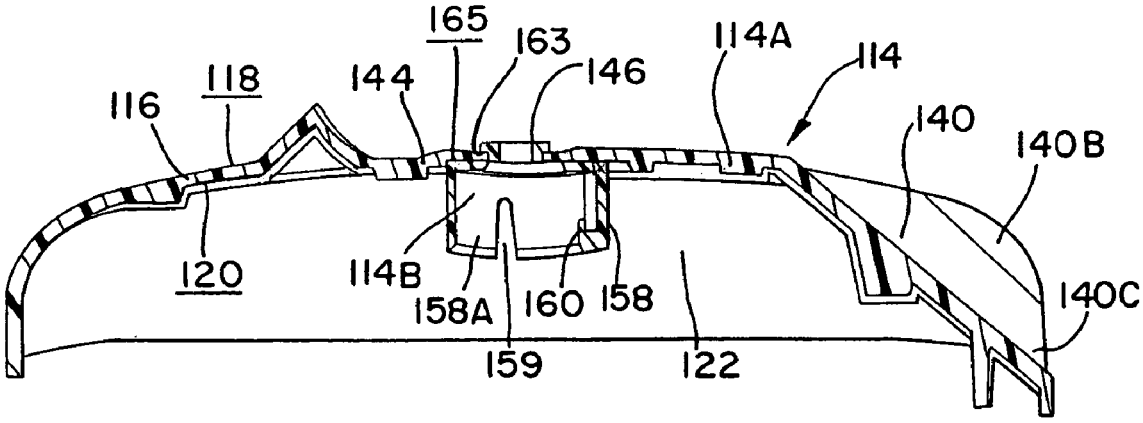
FIG. 14 shows the sectional view of the embodiment of the cover depicted in FIG. 13, depicting a cross-sectional view of the assembled cover, taken along lines 14—14 of FIG. 13, with the mating part that forms the opening that receives and secures the spindle.

In an alternative embodiment, as shown in FIGS. 13 and 14, the cover 114 is constructed of multiple parts that are joined together to form a unified cover 114. In the embodiment shown, the cover 114 is formed as two separate parts, the main cover body 114A and the cover insert 114B. In this embodiment, the cover body 114A has an enlarged opening that is configured to receive a locking portion of the insert 114B. More specifically, the insert 114B engages with the cover body 114A with bayonet arrangement of locking components, with at least one tab 161 (and, preferably at least two tabs 161 as is shown in FIG. 13) extending from the top of the insert 114B in a configuration to align and mate with opening(s) in the cover body 114A. Rotation of the insert 114B, which in turn results in the tabs 161 rotating about the opening 146, results in frictional engagement of the under-surface 163 of the tab(s) 161 against the mating surface 165 of the cover body 114A. This mating and frictional engagement of the insert 114B to the cover body 114A thereby forms a unified construction of the cover 114, with an opening 146 in the middle region 144 that is defined by the opening in the center of the insert 114B.

In the preferred embodiment of this construction shown in FIGS. 13 and 14, the insert 114B is formed as a ring-shaped body with a lower cuff 158A. The cuff 158A is segmented with elongated slits 159, such that the cuff 158A is disjoined and has a plurality of cuff segments, at least one of which forms the finger 158 that provides the teeth structure 160 for engaging the spindle to lock the cover 114 in place. This two-part, or multiple-part, construction of the cover 114 is a preferred form of the structure when the cover is made of metal rather than plastic. Therefore, the cover body 114A is constructed of cast metal, and the cover insert 114B, formed of plastic, is secured to the body 114A by the described bayonet connection, to provide the internal teeth 160 for gripping the spindle at a mating surface of the spindle.

The hub 12 of the operator 10 is pivotally connected to the handle 48 of the operator 10. Specifically, the pin 84 of the first end 72 of the handle 48 is passed through the hole 46 in the arm 32 of the hub 12. The hub 12 of the operator 10 is then operably connected to the portion of the spindle 224 extending through the opening 146 of the cover 114. Specifically, the body 14 of the hub 12 is coupled to the portion of the spindle 224 exposed through the opening 146 in the cover 114 such that the spindle 224 is inserted into the receiver 22 of the hub 12. The splines 226 of the spindle 224 engage the splines 26 on the inner wall 24 of the receiver 22 as the spindle 224 passes into the receiver 22. After the spindle 224 is fully inserted into the receiver 22 of the hub 12, the set screw 30 (FIG. 4) of the hub 12 is tightened until it engages the spindle 224. The set screw 30 helps to prevent disengagement of the hub 12 from the spindle 224. Once the set screw 30 engages the spindle 224, the hub 12 is operably connected to the spindle 224 of the rotary assembly 220.

Once the operator 10 is installed on the casement window 200, the operator 10 is useable by an individual to manually actuate the window assembly 230 within the frame assembly 210 between the open and closed positions. The handle 48 of the installed operator 10 has a first position representing a closed position, a second position representing an open position, and an intermediate position between the closed and open positions. The closed position of the handle 48 is seen in FIG. 2, while the open position is depicted in FIG. 4. FIG. 3 demonstrates the intermediate position of the handle 48.

Figure 2A:
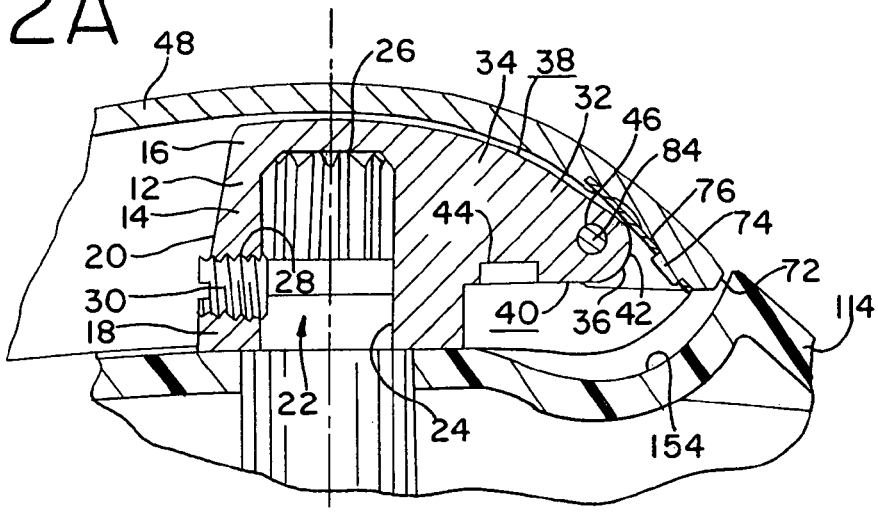
FIG. 2A shows a partial enlarged cross-sectional view of the operator of FIG. 2.

In the closed position, as seen in FIGS. 2 and 2A, the handle 48 of the operator lies substantially flush with the cover 114. Specifically, the peripheral edges 60,62 of the sidewalls 56,58 of the handle 48 lie along the top surface 118 of the base 116 of the cover 114 such that the handle 48 covers a portion of the top surface 118 of the cover 114. In the closed position, the first end 72 of the handle 48 lies proximate the protrusion 152 in the cover 114, such that top surface 52 of the base 50 of the handle 48 is substantially level and flush with the protrusion 152. (See also FIG. 2A.) Both the body 14 and the arm 32 of the hub 12 are positioned within the cavity 112 of the handle 148. More specifically, the top surface 38 of the arm 32 of the hub 12 and the top portion 16 of the body 14 of the hub 12 are proximate the bottom surface 54 of the base 50 of the handle 48. Thus, the hub 12 is positioned beneath the base 50 of the handle 48, and in between the sidewalls 56,58 of the handle 48. In this closed position, the knob 94 of the handle 48 is positioned within the first recess 140 of the cover 114, with a terminal portion of the knob 94 extending out from the depth of the recess 140. A bottom portion of the recess 140 is open, to provide and exposed end surface 101 for the user to engage for lifting the handle 48 from the closed position. The cooperative arrangement of the recess 140 and the exposed end surface 101 of the knob 94 provides an exposed gripping portion of the knob for lifting deployment of the handle. The second end 86 of the handle 48 is proximate the first end 138 of the cover 114. The leaf spring 76 of the handle 48 is unflexed when the handle 48 is in the closed position, as seen in FIG. 2A.

In the open position, as seen in FIGS. 4 and 4A, the handle 48 of the operator 10 extends away from the cover 114 generally at an angle A1. A portion of the top surface 52 of the base 50 of the handle 48 is proximate the top surface 118 of the base 116 of the cover 114. The extended handle 48 uncovers and exposes the hub 12 such that the body 14 of the hub 12 is outboard of the cavity 112. A portion of the arm 32 of the hub 12, specifically the nose 42 and the second end 36 of the arm 32, remains within the cavity 112, as seen in FIG. 4. The knob 94 is outboard of the first recess 140 of the cover 114. In the open position, the bottom surface 54 of the base 50 of the handle 48, nearest the first end 72 of the handle 58, abuts the bottom surface 40 of the arm 32 of the hub 12. This abutting relationship prevents the handle 48 from being pivoted further from the cover 114. In this position, the peg 74 of the handle 48 mates with the well 44 of the bottom surface 40 of the arm 32. The leaf spring 76 of the handle 48 is unflexed when the handle 48 is in the open position, as seen in FIG. 4A.

In a preferred form of the invention, the bottom surface 40 of the hub arm 32 is an under-side surface that is configured to support engagement of a mating surface of the handle 48 and yet be a surface generally concealed from view by a user. This arrangement provides mating engagement between the hub 12 and the handle 48 at a location not readily visible, thereby reducing or eliminating potential damage to the finish of the exposed and visible surfaces.

In the preferred embodiment shown in the Figures, the bottom surface 40 of the hub arm 32 is a flat surface that resides on a plane that is transverse the axis of the spindle 224. In the embodiment shown, the bottom surface 40 is generally perpendicular the axis of the spindle, and having a surface length that is configured to match the extent of the extending body of the first end 72. In this arrangement, the extending body of the first end 72 substantially mates against the bottom surface 40 of the hub arm 32, and the terminal end of the handle first end 72 engages the outer surface 20 of the bottom portion 18 of the hub 12. This mating of the handle surfaces to the two transverse surfaces of the hub provides enhanced support for the handle when extended into the use position, such as show in FIGS. 1, 4 and 4A.

Figure 3A:
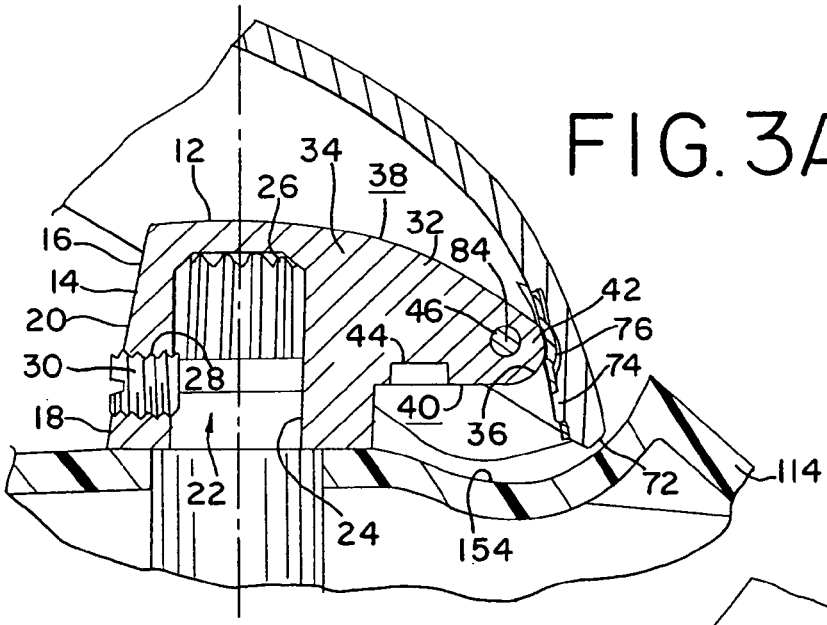
FIG. 3A shows a partial enlarged cross-sectional view of the operator of FIG. 3.

In the intermediate position, the handle 48 may extend from the cover 114 at a plurality of angles between the closed position and the open position. As seen in FIGS. 3 and 3A, the handle 48 extends from the cover 114 at an angle A2. The angle A2 at which the handle 48 extends from the cover 114 in the intermediate position is less than the angle A1 at which the handle 48 extends from the cover 114 in the open position. The knob 94 is at least partially outboard of the first recess 140 in the cover 114. The hub 12 is partially exposed, such that at least a portion of the hub 12 is outboard of the cavity 112 of the handle 48, and a portion of the hub 12 is within the cavity 112 of the handle 48. A portion of the base 50 of the handle 48 proximate the first end 72 of the handle 48 is positioned within the second recess 154 of the cover 114. The nose 42 of the arm 32 of the hub 12 engages the leaf spring 76 causing the leaf spring 76 to flex while the handle 48 is in the intermediate position, as seen in FIG. 3A.

To deploy and operate the operator 10 and casement window 200, the handle 48 of the operator 10 is moved from the closed position through the intermediate position and to the open position. When the handle 48 pivots from the closed position toward the intermediate position, the nose 42 of the arm 32 of the hub 12 engages the leaf spring 76 of the handle 48 causing the leaf spring 76 to be placed in tension (FIG. 3A). Continued pivoting of the handle 48 towards the open position causes the nose 42 to ride along the surface of the leaf spring 76 while the leaf spring 76 is in the flexed position. As the handle 48 pivots further toward the open position, the nose 42 traverses the entire leaf spring 76. As the nose 42 disengages the leaf spring 76, the handle 48 leaves the intermediate position and reaches the open position, and the leaf spring 76 returns to an un-flexed position. It can also be seen that the leaf spring 76 and nose 42 engagement provides a mechanism to maintain or retain the handle 48 in the closed position by resisting pivoting of the handle 48 from the closed position beyond the intermediate position. Adequate force must be provided to the handle 48 to deploy the handle, due to the spaced relationship between the nose 42 and the leaf spring 76.

Once in the open position, the handle 48 of the operator 10 of the present invention may be actuated to rotate the spindle 224 of the rotary assembly 220. Actuation of the spindle 224 is accomplished by gripping the knob 94 of the handle 48, and rotating the handle 48 in a direction about the axis of the spindle 224. Rotation of the handle 48 imparts rotation on the spindle 224, which in turn actuates the window assembly 230 within the frame assembly 210 between the open and closed positions. The direction of rotation of the handle 48 for opening the window is opposite the direction of rotation of the handle 48 for closing the window, and will depend upon the design parameters of the casement window 200 and rotary assembly 220.

When operation or actuation of the casement window 200 is complete, the handle 48 of the operator 10 is moved from the open position through the intermediate position and back to the closed position. A force is applied to the handle 48 of the operator to cause the handle 48 to pivot about the hub 12 and move the handle 48 from the open position into the intermediate position. Similar to the description of opening the handle 48 herein, when the handle 48 pivots from the open position, through the intermediate position and toward the closed position, the nose 42 of the arm 32 of the hub 12 engages the leaf spring 76 of the handle 48 causing the leaf spring 76 to flex (FIG. 3A). Continued pivoting of the handle 48 causes the nose 42 to ride along the surface of the leaf spring 76, thus flexing the leaf spring 76. As the handle 48 pivots further toward the closed position, the nose 42 traverses the entire leaf spring 76 and thereby is disengaged.

In one form of the invention, engagement of the nose 42 with the leaf spring 76 during closing of the operator 10 may be used to prevent the handle 48 from falling under its own weight, particularly when the handle is moved to an advanced extent through the intermediate position. However, in a preferred form of the invention, the leaf spring 76 and nose 42 are in spaced relationship such that the tension on the leaf spring 76 is diminished by the time the handle 48 is moved to approach the closed position. This structure allows the handle 48 to rest in the final closed position by dropping due to the weight of the handle itself.

As depicted in FIGS. 3 and 3A, as the handle 48 is deployed toward the open position, the nose 42 engages the leaf spring 76 and thereby results in frictional engagement of the nose and spring 76 with tension stress being places on the spring 76. The tension increases the frictional engagement between the spring 76 surface and the nose 42, thereby increasing the resistance from handle movement. The end result provides a structure in which the handle has restricted movement or play, thereby giving the user the sensation that the handle components are securely connected. As the handle is extended toward the fully deployed position, the spacial relationship of the nose 442 to the leaf spring 76 is significantly reduced which thereby provides reduced tension on the spring 76 in a rapid sloping rate of decreased tension. The rapid rate of decreased tension facilitates the final movement of the handle into the fully extended open position. This is due to the leaf spring 76 being forced against the nose 42, there being a path of reduced tension on the leaf spring 76 as the handle is opened further. Once the handle is fully deployed, the leaf spring 76 and nose 42 are minimally engaged, or entity disengaged. And the proximity of the nose 42 to the leaf spring 76 provides a mechanical blocking resistance to retain the handle 48 in the open position. This structure thereby provides resistance that must be overcome with an appropriate pre-determined amount of force on the handle 48 towards the closed position, to begin flexing the leaf spring 76. Alteration of this pre-determined amount of force needed for overcoming the resistance may be made by either changing the leaf-spring material or thickness, or altering the spacial relationship between the leaf spring 76 and the surface of the nose 42.

It should be recognized that, although the present invention has been shown and described as having the leaf spring 76 located in the handle, and the opposed surface that engages the leaf spring 76 is described as being a nose 42 of the arm 12, the same arrangement and structural engagement of components is achieved by reversing the location of these components. For example, the leaf spring structure 76 may be located on the hub 12, and the engaging nose 42 surface would thereby be located on the handle 48. This reversal of parts that provide frictional engagement of the handle relative the hub during deployment of the handle 48 is contemplated within the present description of the invention.

The operator 10 of the present invention offers a variety of benefits over the traditional crank handle operator. First, the operator 10 of the present invention provides a vastly improved aesthetic appearance. When in the closed position, the handle 48 lies flush over the cover 114 hiding the hub 12 and creating a streamlined smooth appearance which is visually pleasing. Secondly, the operator 10 of the present invention reduces risk of injury or damage due to its ability to lie flush in the closed position. The traditional crank handle extends outward away from the frame assembly 210 when not in use, exposing it to individuals who may pass by the casement window 200. If an individual walking in the vicinity of the casement window 200 does not see the exposed handle, the handle may be inadvertently hit or bumped. Because the operator 10 of the present invention lies flush with frame assembly 210 of the casement window 200 while in the closed position, the risk of the operator 10 interfering with an individual walking by the casement window 200 is reduced. The foldability of the operator 10 of the present invention provides the additional advantage over the traditional handle of not interfering with the operation of window treatments such as blinds, curtains, and shades. When the operator 10 is not in use, it is placed in the closed position where it lies flush with the frame assembly, and not in the path of movement of such window treatments. The cooperation of the hub 12 and leaf spring 76 as described above provides further improved operation of the operator 10.

While the specific embodiments and various details thereof have been illustrated and described, numerous modifications come to mind without significantly departing from the spirit of the invention and the scope of protection is only limited by the following claims.

What is claimed is:

1. An operator for a rotatable spindle, comprising:

a hub, the hub having a receiver and an arm extending from the receiver, the receiver adapted to connect to the spindle; and a handle having a base and a pair of sidewalls extending from the base, wherein the base and sidewalls define a cavity, the base having a top surface and a generally opposed bottom surface;

a leaf spring connected to the handle, the leaf spring positioned between the sidewails and having an entire length of the leaf spring confronting the bottom surface of the base and at least a part of the entire length of the leaf spring confronting the arm;

wherein the handle is pivotally connected to the arm, the handle pivotable between a closed position wherein the hub is substantially positioned within the cavity, and an open position, wherein a portion of the hub is substantially outboard of the cavity.

2. The operator of claim 1 wherein the handle further comprises a knob rotatably connected to the base.

3. The operator of claim 1 wherein the receiver has a bore adapted to receive a portion of the spindle.

4. The operator of claim 1 wherein the leaf spring retains the handle in the open position.

5. The operator of claim 1 wherein the leaf spring is positioned in spaced relationship from an engagement surface of a nose on the arm.

6. The operator of claim 1 further comprising a pin, wherein the pin pivotally connects the handle to the arm.

7. The operator of claim 1 wherein the leaf spring is in spaced relationship from a mating surface of the arm and wherein the handle is movable to a deployed position such that the leaf spring is brought into engagement with the mating surface.

8. The operator of claim 7 wherein an intermediate position is defined between the closed position and the open position, wherein the arm flexes the leaf spring when the handle is in the intermediate position.

9. The operator of claim 8 wherein the flexing of the leaf spring provides tension that supports the weight of the handle.

10. The operator of claim 8 wherein the arm flexes the leaf spring as the handle moves towards the open position to thereby provide a force of frictional engagement between the spring and the mating surface.

11. The operator of claim 7 wherein the handle drops back to the closed position when the handle moves from the intermediate position to the closed position and the leaf spring is no longer engaged with the mating surface.

12. The operator of claim 1 wherein the leaf spring is un-flexed when the handle is in the closed position.

13. The operator of claim 1 wherein the leaf spring is un-flexed when the handle is in the open position.

14. A fold down operator for a rotatable spindle of a casement window assembly, the operator comprising:

a hub, the hub having a receiver and an arm extending from the receiver, the receiver adapted to connect to the spindle;

a handle having a base and a pair of sidewalls extending from the base, wherein the base and sidewalls define a cavity, the base having a top surface and a generally opposed bottom surface;

a leaf spring connected to the handle, the leaf spring positioned between the sidewalls and having an entire length of the leaf spring confronting the bottom surface of the base and at least a pan of the entire length of the spring confronting the arm;

wherein the handle is pivotally connected to the arm, the handle pivotable between a closed position wherein the hub is substantially positioned within the cavity, and an open position, wherein a portion of the hub is outboard of the cavity.

15. The operator of claim 14 further comprising a pin, wherein the pin pivotally connects the handle to the arm.

16. The operator of claim 14 wherein the arm is positioned within the cavity when the handle is in the closed position.

17. The operator of claim 14 wherein the entire receiver is positioned within the cavity when the handle is in the closed position.

18. The operator of claim 14 wherein the leaf spring confronts the arm as the handle is pivoted from the closed position to the open position, to maintain the handle in the open position.

19. The operator of claim 14 wherein an intermediate position is defined between the closed position and the open position, wherein the arm flexes the leaf spring when the handle is in the intermediate position.

20. The operator of claim 19 wherein the flexing of the leaf spring provides tension that supports the weight of the handle.

21. The operator of claim 19 wherein the arm flexes the leaf spring in a second portion of the intermediate position as the handle moves towards the closed position providing tension that supports the weight of the handle.

22. The operator of claim 19 wherein the handle snaps into the open position when the handle moves from the intermediate position to the open position.

23. The operator of claim 14 wherein the leaf spring is un-flexed when the handle is in the closed position.

24. The operator of claim 14 wherein the leaf spring is un-flexed when the handle is in the open position.

25. A fold down operator for a rotatable spindle of a rotary device for a casement window assembly, the operator comprising:

a hub, the hub having a receiver and an arm extending from the receiver, the receiver adapted to connect to the spindle, the arm having an opening;

a handle having a base and a pair of sidewalls extending from the base, wherein the base and sidewalls define a cavity, the base having a top surface and a generally opposed bottom surface;

a leaf spring connected to the handle and confronting the arm, the leaf spring positioned between the sidewalls, the leaf spring having an entire length of the leaf spring confronting the bottom surface of the base and at least a part of the entire length of the spring confronting the arm;

a pin pivotally connecting the handle to the arm, wherein the handle is pivotable between a closed position wherein the hub is substantially positioned within the cavity, and an open position, wherein a portion of the hub is outboard of the cavity.

26. The operator of claim 25 further comprising a cover adapted to cover the rotary device.

27. The operator of claim 26 wherein the handle is positioned substantially flush with the cover when the handle is in the closed position.

28. The operator of claim 26 wherein the cover has an opening adapted to be positioned around the rotatable spindle.

29. The operator of claim 26 wherein die cover has a recess, wherein the handle has knob, wherein the recess receives the knob when the handle is in the closed position.

30. The operator of claim 25 wherein the handle has a first end and a second end, wherein the handle has a knob rotatably connected to the second end.

31. The operator of claim 25 wherein the handle further has an intermediate position between the open position and closed position.

32. The operator of claim 31 wherein the arm confronts and flexes the leaf spring when the handle is in the intermediate position.

33. The operator of claim 32 wherein the leaf spring is unflexed when the handle is in an approximate second half of the intermediate position towards the closed position.

34. The operator of claim 25 wherein the leaf spring is un-flexed when the handle is in the open position.

35. The operator of claim 25 wherein the leaf spring is un-flexed when the handle is in the closed position.

36. A fold down operator for a rotatable spindle of a window assembly, the operator comprising:

a hub having a receiver adapted to connect to the spindle, the hub further having an arm;

a handle pivotally connected to the arm, the handle having a base and a pair of sidewalls extending from the base, wherein the base and sidewalls define a cavity, the base having a top surface and a generally opposed bottom surface, the base having a peg extending into the cavity, each sidewall having a slot;

a leaf spring connected to the handle and confronting the arm, the leaf spring having a hole, the leaf spring received by the slots and the hole receiving the peg, the leaf spring having an entire length of the leaf spring confronting the bottom surface of the base and at least a part of the entire length of the spring confronting the arm;

wherein the handle is movable between a closed position and an open position, an intermediate position defined between the closed position and the open position, wherein the arm flexes the leaf spring when the handle is in the intermediate position.

37. The operator of claim 36 wherein the flexing of the leaf spring provides tension that supports the weight of the handle.

38. The operator of claim 36 wherein the handle snaps into the open position when the handle moves from the intermediate position to the open position.

39. The operator of claim 36 wherein the leaf spring is un-flexed when the handle is in the closed position.

40. The operator of claim 36 wherein the leaf spring is un-flexed when the handle is in the open position.

41. An operator for a rotatable spindle for a casement window, comprising:

a cover having a cover body with an opening configured for passage of a window spindle, and having an outer recess formed of generally opposed sidewalls with an open terminal end of the recess;

a hub having a receiver configured for connection to a window spindle and having an arm extending radially outward of the receiver;

a handle pivotally connected to the hub at a hinge axis and having a knob positioned on the handle opposite the hub connection, the handle being movable relative said cover between a use configuration extending away from the cover, to a storage configuration wherein an extent of the knob is positioned within the recess and a gripping portion of the knob is exposed within the recess at the recess open end, the handle further having a base and a pair of sidewalls extending from the base, wherein the base and sidewalls define a cavity, the base having a top surface and a generally opposed bottom surface; and a leaf spring connected to the handle, the leaf spring positioned between the sidewalls and having an entire length of the leaf spring confronting the bottom surface of the base and at least a part of the entire length of the leaf spring confronting the arm.

42. The operator of claim 41, wherein the knob has a terminal end surface that is exposed at the open terminal end of the cover recess.

43. The operator of claim 41, wherein at least a portion of the knob extends outward of the cover recess when the handle is in the storage configuration.

44. The operator of claim 41, wherein the leaf spring is positioned to engage a surface of the arm when the handle is moved between use and storage configurations.

45. The operator of claim 44, wherein the leaf spring is positioned relative the arm to engage a protruding terminal end of the arm.

46. The operator of claim 45, wherein the protruding end of the arm comprises a body portion having a terminal end surface, and a thickness between the terminal end surface and die hinge axis being greater than a thickness between an adjacent surface and the hinge axis.

47. A fold down operator for a rotatable spindle of a window assembly, the operator comprising:

a hub having a receiver adapted to connect to the spindle, the hub further having an arm;

a handle pivotally connected to the arm, the handle having a first end and a second end, the first end located proximate the hub, the handle further having a base and a pair of sidewalls extending from the base, wherein the base and the sidewalls define a cavity, the base having a top surface and a generally opposed bottom surface, and the sidewalls having a pair of slots;

a pin pivotally connecting the handle to the arm;

a leaf spring, wherein the leaf spring is positioned between the pair of sidewalls and received by the pair of slots, an entire length of the leaf spring generally confronting the bottom surface of the base of the handle proximate the first end of the handle, and at least a part of the entire length of the spring confronting the arm;

wherein the handle is movable between a closed position, an open position, and an intermediate position defined between the closed position and the open position, wherein the arm flexes the leaf spring when the handle is in the intermediate position.

* * * * *

UNITED STATES PATENT AND TRADEMARK OFFICE

CERTIFICATE OF CORRECTION

PATENT NO. : 7,147,256 B2
APPLICATION NO. : 10/811064
DATED : December 12, 2006
INVENTOR(S) : David B. Gill It is certified that error appears in the above-identified patent and that said Letters Patent is hereby corrected as shown below:

Claim 29, column 13, line 56, delete “die” and insert -- the --

Claim 29, column 13, line 57, delete “has knob” and insert -- has a knob --

Claim 46, column 15, line 16, delete “die” and insert -- the --

Signed and Sealed this

Twenty-ninth Day of April, 2008

JON W. DUDAS
*Director of the United States Patent and Trademark Office*